United States Patent [19]

Harding

[11] Patent Number: 4,934,301

[45] Date of Patent: Jun. 19, 1990

[54] ATTACHMENT OF TUBES IN INFLATABLE BOATS

[75] Inventor: Richard J. A. Harding, Dyfed, Great Britain

[73] Assignee: Avon Inflatables Limited, Melksham, England

[21] Appl. No.: 287,827

[22] Filed: Dec. 15, 1988

[30] Foreign Application Priority Data

Dec. 16, 1987 [GB] United Kingdom ..... 8729338
Feb. 23, 1988 [GB] United Kingdom ..... 8804182

[51] Int. Cl.[5] ..... B63B 7/08
[52] U.S. Cl. ..... 114/345; 441/40
[58] Field of Search ..... 114/343, 345, 354, 355, 114/357, 358, 364, 267, 266; 441/40–42

[56] References Cited

U.S. PATENT DOCUMENTS

| | | | |
|---|---|---|---|
| 3,453,671 | 7/1969 | Mambretti | 114/345 |
| 3,490,085 | 1/1970 | Lewis | 114/345 |
| 3,566,425 | 3/1971 | Welty | 114/345 |
| 3,608,112 | 9/1971 | Irgens | 114/345 |
| 4,329,751 | 5/1982 | Cigognetti | 114/345 |

FOREIGN PATENT DOCUMENTS

| | | | |
|---|---|---|---|
| 0024401 | 6/1984 | European Pat. Off. | 114/345 |
| 1189438 | 1/1958 | France | 114/345 |
| 2294907 | 11/1973 | France | 114/345 |
| 2161118 | 6/1984 | United Kingdom | 114/345 |

*Primary Examiner*—Joseph F. Peters, Jr.
*Assistant Examiner*—Clifford T. Bartz
*Attorney, Agent, or Firm*—Cushman, Darby & Cushman

[57] ABSTRACT

To secure a tube (6) to the hull (4) of a rigid inflatable boat (2) a rigid plate (10) is retained at the outside of the tube by means of a pocket (14) and there offers an anchorage for securing means (e.g. nut and bolt 22,24) penetrating a flange (12) of the hull.

5 Claims, 1 Drawing Sheet

ATTACHMENT OF TUBES IN INFLATABLE BOATS

This invention relates to means for attaching buoyancy tubes to the rigid hull of a boat.

BACKGROUND OF THE INVENTION

The boats to which this invention is applicable are commonly known as rigid-hull inflatable boats, and have an inflatable tube wall or "buoyancy tube" attached to the upper rim of a rigid hull. Many methods of attaching the tube(s) to the hull are known; some provide a removable attachment, others a permanent one. Removable attachments are preferred as they permit much easier repair or replacement of the tube(s) without the need to take the boat out of service for long periods.

Known removable attachments include that described in EP-B No. 024401, in which a rigid reinforcement is sealed onto the inner surface of the tube during its manfacture. The resulting rigid surface portion of the tube can then be bolted onto a horizontal flange extending around the rim of the boat hull. The main disadvantage of this method of attachment is that the rigid reinforcement must be incorporated into the inflatable tube during manufacture. This considerably increases the cost of manufacture—particularly since the reinforcement must be sealed to the tube—and also means that the system cannot be used on existing tubes. Furthermore, once removed and deflated the tube will be difficult to handle.

SUMMARY OF THE INVENTION

The present invention overcomes the above disadvantages by providing a much simpler means of attachment which can be added to boat tubes at any time.

The invention provides means for attaching a buoyancy tube to the rigid hull of a boat, comprising at least one plate attached to the tube by location in a pocket on the exterior of said tube such that the surface of the plate facing the tube is adjacent the continuous outer surface of the tube. The plate may be releasably secured to the hull by means penetrating the external wall of the pocket.

It is preferred that the securing means comprises at least one nut bolt or like clamping arrangement, such that the plate can simply be screwed onto the hull, and unscrewed when desired. The nut and bolt may both be separate from the plate and hull, in which case they are screwed together through matching holes or slots provided in the plate, sleeve and hull respectively.

In an alternative and preferred arrangement, one half of the nut and bolt is permanently attached to the plate. This may a screw-threaded bolt projecting from the plate through the pocket, the bolt being inserted through a hole or slot in the hull and then clampled by a nut; or alternatively it may be a screw-threaded insert provided in the plate for receiving a bolt through respective holes or slots in the hull and sleeve.

It is preferred that the buoyancy tube has a plurality of plates extending successively along its length, each of which is individually secured to the hull in one of the manners described above. The plates are generally planar, but may be shaped to correspond more closedly to the contours of the hull portion to which they are attached. This hull portion usually comprises a substantially horizontal flange extending around the rim of the hull.

The plates may be loose fitting in the sleeve, which extends around the length of the tube, so that they can be removed if desired when not secured to the hull. Preferably however the plates are permanently bonded to both the tube and pocket (although it is possible for some plates to be permanently attached and others loose).

The above arrangement enables rapid removal and replacement of a buoyancy tube, by simply undoing the securing means positoned along the rigid hull wall. When deflated and removed, a tube having a plurality of separate plates can be conveniently packed for folding, and can be easily transported.

DESCRIPTION OF THE DRAWINGS

An embodiment of the invention will now be described by way of example with reference to the accompanying drawings, in which:

FIG. 1 shows diagrammatically a rigid inflatable boat 2 having a rigid hull portion 4 and an inflatable buoyancy tube 6 extending around the upper periphery of the hull 4. The tube is secured to the hull by bolts 8 extending from a series of rigid plates 10 which are attached, as will be described, to the underside of the tube along its length. The plates may be slightly curved to conform to the outer surface of the tube and to a flange of the hull which is to receive them. Specially shaped plates 11 serve to secure the tube to the boat transom 13. Typically two bolts are sufficient for each plate.

Figure 2:
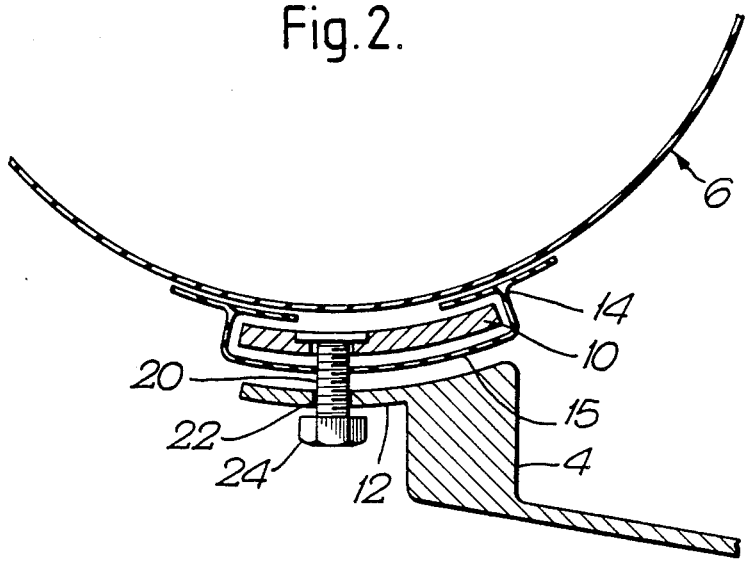
FIG. 2 is a vertical section through a buoyancy tube and hull of the boat.

The securing arrangement is shown in detail in FIG. 2. The tube 6 sits on a substantially horizontal flange 12 extending outwardly from the rigid hull 4, such that a plate 10 attached to the underside of the tube is aligned with the flange 12. The plate 10 is encased in a pocket 14 formed by sealing a layer 15 of fabric to the uninterrupted fabric outer surface of the tube 6; the plate itself may be sealed to both the fabric layer 15 and the outer surface of the tube so that it is effectively an integral part of the tube.

Both the pocket and the tube are made preferably of conventional reinforced-elastomer material.

Figure 1:
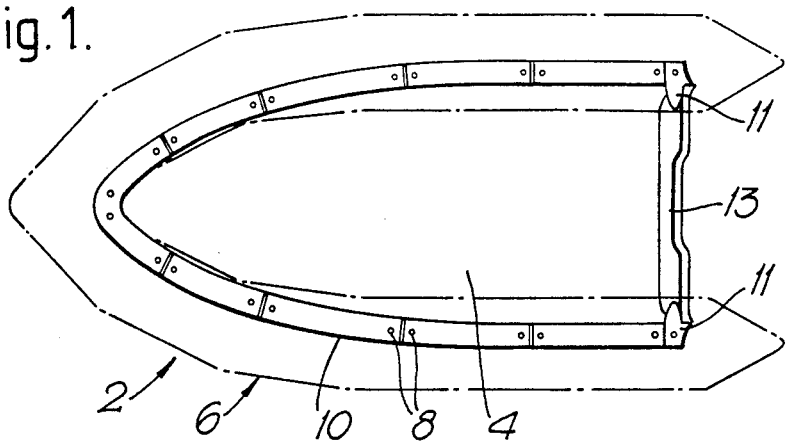
FIG. 1 is a diagrammatic plan view of one rigid inflatable boat of the invention.

Incorporated into plate 10 is at least one threaded stud 20 which projects through a hole in the fabric layer 15 of the pocket 14. The plate, with its stud or studs, is slid into the pocket 14 when the tube 6 is deflated and the projecting stud(s) pushed through corresponding hole(s) in the pocket wall; the plate can then be bonded to the outer surface of the tube and the layer 15 of the pocket to form a permanent attachment. The stud is received through a hole or slot 22 in the flange 12 of the hull, where it is secured by a complementary nut 24. As shown in FIG. 1, a succession of such nuts and studs extending along the length of the tube 6 secures the tube to the flange 12 of the hull.

It will be appreciated that rather than incorporating a bolt 20 into the plate 10, a female threaded insert could be provided which cooperates with a bolt passed up through the hull flange. Alternatively, in another embodiment in which the plate 10 is not bonded into the pocket 14, so that it can be removed, the plate may simply be provided with a hole or slot corresponding to the holes or slots in the hull and pocket, and external nuts and bolts employed to clamp the plate to the flange.

Although FIG. 2 shows the tube 6, pocket 14 and hull flange 12 slightly spaced for the sake of clarity, in reality the plate 10 is clamped fast against the flange 12 to prevent or reduce leakage of water inwardly of the boat along the interface. A more effective water seal is achieved by providing on the inboard or outboard side of the boat wall, or both, a sealing flap or rib (not shown) either permanently bonded to the hull flange or th the tube itself. This seal can be of extruded rubber or expanded foam, or fabricated from a waterproof cloth.

As has already been described, a buoyancy tube secured to a hull in this manner may be easily removed by an unskilled workman, requiring only means for unscrewing a nut or bolt. Even if the tubes are segmented i.e. a plurality of tubes lie end-to-end on each side of the boat, plates may be used. Further, the tube(s) may be packed easily when removed and deflated, owing to the relatively short length of each rigid plate. A further advantage is that existing buoyancy tubes can be converted to this method of attachment by simple addition of parts to the outer surfaces of the tubes.

Other methods of assembling the plate to the tube include after having made the tube, laying the plates along the desired longitudinal area of the tube and simply applying the pocket-forming layer over them and bonding its edges to the tube at each side of the plate. Furthermore the surface(s) of the plate may be bonded to the tube and the pocket-forming layer in the same operation is desired. Also if desired an additional cushioning layer of elastomer may be inserted between the plate and the tube to obviate wear or rubbing on the tube due to any projections in the plate or due to the edges of the plate.

Figure 3:
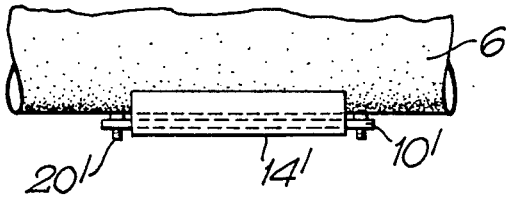
FIG. 3 is a scrap side view of a modification.

In the case where the plate is loose in the pocket it may be inserted, even if it has permanently attached studs or the like, after the formation of the pocket. This is especially so if the longitudinal length of the plate is greater than that of the pocket and the studs are at its respective ends. Then, as seen in FIG. 3 the plate 10' may in the deflated condition of the tube be slipped through the pocket 14' which is relaxed by the deflation of the tube. Upon inflation of the tube it will be held firmly in the pocket with the studs 20' pointing in the appropriate direction at positions beyond the longitudinal ends of the pocket. Alternatively if the plate is shorter than the pocket it can be fitted after the formation of the pocket if the pocket has been formed with apertures to allow the studs to penetrate outwardly.

The studs may be held against rotation by welding to the plate or the use of coach bolts in a square aperture through the plate or by letting in a hexagonal recess at one surface of the plate into which a head of a conventional bolt fits and is holding its rotation.

As already stated, the plates may have a nut or other female securing element upon them, to be engaged by a bolt or other appropriate male securing element from the hull.

The pockets and plates need not be at the portion of the tube which is lowermost in use. They could be at any part of the tube which is appropriate to the relationship between the tube and the hull. For example, in some patterns of hull the tube is mounted outboard of the side of the hull (see UK-A-85.16343) and in that case the plates would be secured along a vertical tangent of the tube.

I claim:

1. A rigid hull inflatable boat, comprising:

a rigid hull having two lateral edges;

a flange surface at each of said edges extending longitudinally along said rigid hull and having an array of apertures therethrough;

a buoyancy tube of flexible material, said buoyancy tube defining an inflatable envelope having an integral wall with inside and outside surfaces; and means for securing portions of said buoyancy tube to said flanges, said securing means comprising:

a plurality of rigid plates; and retaining means for retaining said rigid plates, said retaining means comprising:

a pocket of flexible material secured to said outside surface of said buoyancy tube configured so as to secure said rigid plates between a portion of said pocket and said buoyancy tube and retaining said rigid plates in an orientation corresponding to said array of apertures in said longitudinally extending flange surface of said hull; and a plurality of securing elements passing through said apertures acting on said flange and said rigid plates respectively for drawing together said rigid plates and the surface of said flange so as to compress said flexible material of said retaining means therebetween, whereby said inside surface of said integral wall of said inflatable envelope is not penetrated by said securing elements.

2. A rigid hull inflatable boat as described in claim 1, wherein said securing elements include:

threaded apertures in said rigid plates;

threaded bolts having stems passing through said apertures threadedly engaged with said threaded apertures, the heads of said threaded bolts acting on a portion of said flange surface remote from said buoyancy tube.

3. A rigid inflatable boat as claimed in claim 1 wherein at least one said securing element passes through said fabric of said pocket.

4. A rigid inflatable boat as claimed in claim 1 wherein at least one said securing element is positioned beyond a longitudinal end of said pocket.

5. A rigid inflatable boat as claimed in claim 1 wherein said rigid plates are bonded to at least one of said pocket and said tube.

* * * * *